US006691617B2

(12) United States Patent
Emery et al.

(10) Patent No.: US 6,691,617 B2
(45) Date of Patent: Feb. 17, 2004

(54) APPARATUS FOR SELECTIVELY CLEANING A PRINTING PRESS CYLINDER

(75) Inventors: David Crowell Emery, York, ME (US); David Charles Gibson, Dover, NH (US); Chad Clifford Merwin, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 4 days.

(21) Appl. No.: 09/818,370

(22) Filed: Mar. 27, 2001

(65) Prior Publication Data

US 2002/0139268 A1 Oct. 3, 2002

(51) Int. Cl.[7] ..... B41F 35/00
(52) U.S. Cl. ..... 101/424; 101/425
(58) Field of Search ..... 101/424, 423, 101/425; 15/256.52, 256.51, 256.5, 256.53; 399/353

(56) References Cited

U.S. PATENT DOCUMENTS 1,903,867 A * 4/1933 Lehmann ..... 15/DIG. 5
2,575,635 A * 11/1951 Meyer et al. ..... 15/181
2,730,770 A * 1/1956 Higginbotham et al. . 15/256.52
4,015,307 A * 4/1977 Kossak ..... 101/425
4,499,827 A 2/1985 Takeuchi et al. ..... 101/425
4,556,453 A * 12/1985 Meinecke ..... 162/274
4,922,820 A * 5/1990 Grossmann et al. ..... 101/425
5,020,433 A 6/1991 Jeschke et al. ..... 101/425
5,257,578 A 11/1993 Jackson et al. ..... 101/425
5,519,480 A * 5/1996 Thayer et al. ..... 355/301
5,732,631 A * 3/1998 Walther et al. ..... 101/424
5,943,956 A * 8/1999 Marquez et al. ..... 101/425
6,513,432 B1 * 2/2003 Richter ..... 101/425

* cited by examiner

*Primary Examiner*—Anthony H. Nguyen
(74) *Attorney, Agent, or Firm*—Davidson, Davidson & Kappel, LLC

(57) ABSTRACT

An apparatus for cleaning one or more selected portions of a surface of a cylinder of a printing press includes a plurality of brush elements disposed adjacent one another opposite the surface of the cylinder. A device for selectively moving one or more of the plurality of brushes to contact the selected portion or portions of the surface of the cylinder so as to clean the selected portion or portions is provided.

10 Claims, 3 Drawing Sheets

APPARATUS FOR SELECTIVELY CLEANING A PRINTING PRESS CYLINDER

BACKGROUND OF THE INVENTION

1. Field of the Invention

The present invention relates generally to printing presses and more particularly to a device and method for cleaning one or more selected portions of a cylinder of a printing press.

2. Background Information

Offset lithographic printing presses, for example, have a blanket cylinder for transferring images from a printing cylinder to a web of material, such as paper. Blankets on the blanket cylinder typically have a rubber outer print layer, while printing plates on the printing plate cylinder typically are made of metal.

Especially after continued use, blanket and printing plate cylinders accumulate foreign matter such as ink, lint, dust, clay, dirt and the like which should be removed by cleaning. Lack of proper cleaning can lead to poor print quality and reduce press productivity. Many times, only a small area of a blanket or printing plate needs to be cleaned. While various cleaning methods and devices are known, many are not capable of doing spot-cleaning. Those that are capable of spot-cleaning are often too slow.

U.S. Pat. No. 5,257,578 describes an automatic cleaning device using a brush roller for cleaning blanket cylinders in a web fed offset lithographic printing press. The device is not capable of doing spot cleaning, however.

German Patent Document No. DE-OS 34 10 376 and its equivalent U.S. Pat. No. 4,499,827 describe a cleaning device for doing spot-cleaning in which a small cleaning element must be moved transversely across a cylinder to a specific location to be spot cleaned. The positioning of the cleaning element is time-consuming.

U.S. Pat. No. 5,020,433 describes a cleaning device in which subsets of a plurality of scraper, or doctor, blades may be selectively positioned for cleaning specific areas of a plate and a blanket cylinder in an offset printing machine. Scraper, or doctor, blades do not work well for cleaning ink residues on blanket, for example, cylinders as the blades tend to smear rather than remove the ink.

BRIEF SUMMARY OF THE INVENTION

An object of the present invention is to provide a device and method for selectively, or spot, cleaning a surface of a printing press cylinder.

The present invention provides an apparatus for cleaning one or more selected portions of a surface of a cylinder of a printing press, the apparatus comprising:

- a plurality of brush elements disposed adjacent one another opposite the surface of the cylinder; and
- a device for selectively moving one or more of the plurality of brushes to contact the one or more selected portions of the surface of the cylinder so as to clean the one or more selected portions.

Each of the brush elements may include a brush wheel, which may be rotated about a respective axis.

The device for selectively moving one or more of the plurality of brush elements may include a pneumatic, a hydraulic, a lever, a cam, an electrical and/or a magnetic actuator.

The device for selectively moving one or more of the plurality of brush elements may be controlled using a logic used to zone-control ink fountains of the printing press.

The brush elements may be movable along a part of the surface so as to improve the cleaning and/or to clean an area of the surface at a gap between adjacent ones of the brush elements.

An apparatus according to the present invention may include a spray device controllable to selectively deliver a cleaning liquid to the one or more of the plurality of brushes or the one or more selected portions of the surface.

The present invention also provides an apparatus for cleaning one or more selected portions of a surface of a cylinder of a printing press, the apparatus comprising:

- a washer cloth disposed opposite the surface of the cylinder; and
- a device for selectively moving one or more areas of the cloth to contact the surface of the cylinder so as to clean the one or more selected portions of the surface.

The device for selectively moving one or more areas of the cloth may include a plurality of adjacent air bladders capable of being selectively actuated.

The device for selectively moving one or more areas of the cloth may include a plurality of adjacent pushing elements capable of being selectively actuated.

The plurality of adjacent pushing elements may be capable of being selectively actuated using a logic for zone-controlling ink fountains of the printing press.

Each of the brush elements may include a pneumatic, a hydraulic, a lever, a cam, an electrical and/or a magnetic actuator.

An apparatus according to the present invention may include a spray device controllable to selectively deliver a cleaning liquid to the one or more areas of the cloth or the one or more selected portions of the surface.

The spray device may include a plurality of spray nozzles capable of being independently actuated in concert with the moving of the one or more of the areas of the cloth to contact the surface of the cylinder.

The present invention also provides a method for cleaning one or more selected portions of a surface of a cylinder of a printing press, the method comprising:

- providing a segmented cleaning device opposite a surface of the cylinder, the segmented cleaning device including at least one of a segmented washer cloth device and a plurality of brush elements disposed adjacent one; and
- selectively moving one or more segments of the cleaning device into contact with the one or more selected portions of the surface of the cylinder so as to clean the one or more selected portions of the surface.

The segmented washer cloth device may include a washer cloth and a plurality of adjacent air bladders capable of being selectively actuated or a plurality of adjacent pushing elements capable of being selectively actuated so as to move one or more areas of the washer cloth into contact with the one or more selected portions of the surface of the cylinder.

The selectively moving the one or more of the segments may be performed using a pneumatic, a hydraulic, a lever, a cam, an electrical and/or a magnetic actuator.

The device for selectively moving one or more segments of the cleaning device may be controlled using a logic used to zone-control ink fountains of the printing press.

The cylinder cleaned may be a blanket cylinder or a printing plate cylinder.

The present invention enables spot cleaning, as well as full cylinder-width cleaning and variable partial, for example one third-width, cleaning of a surface of printing press cylinder.

BRIEF DESCRIPTION OF THE DRAWINGS

Similar elements are numbered similarly in the figures.

DETAILED DESCRIPTION

Figure 1:
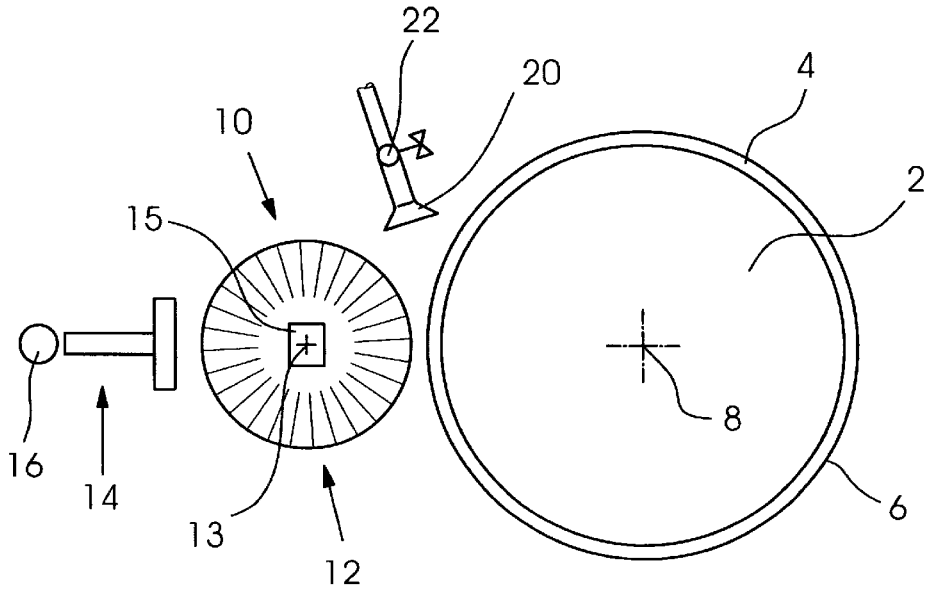
FIG. 1 shows a side schematic view of a printing press cylinder with a cleaning apparatus including a plurality of brush elements.

FIG. 1 shows a side cross-sectional view of a printing press cylinder 2 with a cleaning apparatus 10 including a plurality of brush elements 12. Printing press cylinder 2, which rotates about axis 8, may be a blanket or a plate cylinder and includes overlay 4 mounted thereon. Overlay 4 is a blanket or a printing plate, corresponding to whether press cylinder is a blanket or a plate cylinder.

Figure 2:
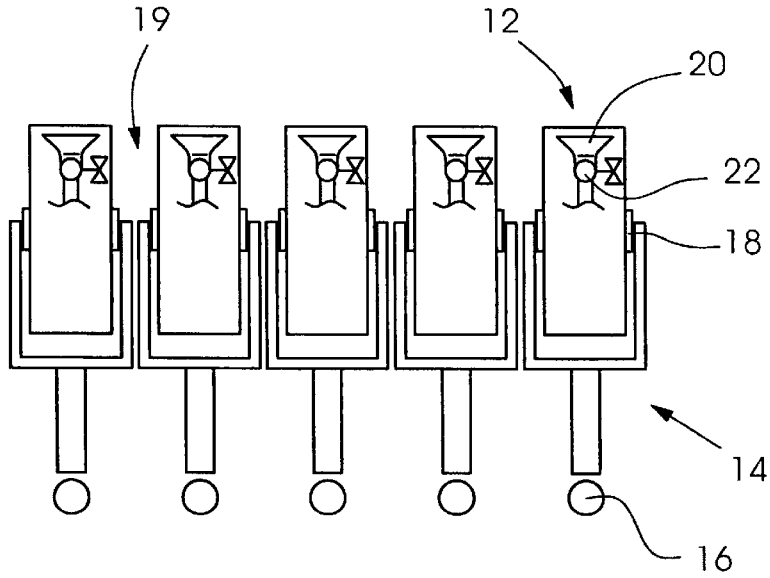
FIG. 2 shows a top schematic view of the cleaning apparatus shown in FIG. 1.

With additional reference to FIG. 2, brush elements 12 are each supported by a support 14 and independently movable to contact a portion of surface 6 of overlay 4 under an action of actuator 16. Brush elements 12 may be brush wheels, which may be each rotated about axis 13 under the action of one or more drivers 15, or other brush devices. Drivers 15 may be moved by a common motive source, or drivers 15 may be individual motors and/or gear drive systems, for example, and may include clutching mechanisms. Brush elements 12 may be generally held stationary until rotated, for example in an indexed fashion in small angular increments, for cleaning operations. Supports 14 may include bearings 18. Gaps 19 may be formed between adjacent brush elements 12 due to the space occupied by supports 14. Brush elements may be movable, for example in an oscillating fashion, on surface 6 of press cylinder 2 so as to scrub the surface and/or clean areas of the surface at gaps 19.

Actuators 16 may include any of pneumatic, hydraulic, lever, cam, electrical and magnetic devices suitable for selectively moving one or more of the supports 14, along with its respective brush element 12, to surface 6. The specific construction of such actuators would be known by those of skill in the art. Control of actuators 16 may be integrated into, or share process logic with, a device for controlling ink fountains (not shown) of a printing press of which printing press cylinder 2 is a part. In this way, control of actuators 16 may be effected according to the logic for controlling the ink fountains.

By appropriately controlling actuators 16 to move desired subsets of brushes 12 to surface 6 of printing press cylinder 2, one or more selected portions of the surface may be cleaned to remove foreign matter (ink, lint, dust, clay, dirt, etc.) by one or more of brush elements 12. In this way, surface 6 may be spot-cleaned expeditiously without the need to clean the entire area of surface 6. The spot-cleaning may be performed at operational press speed or at a slower crawl speed, so that the selected portions of surface 6 move past the corresponding brush elements as cylinder 2 rotates about axis 8. As noted above, brush elements 12 may be designed to be oscillated, for example parallel to axis 8 so as to impart a scrubbing movement and improve the cleaning action and/or to clean surface areas at gaps 19. A collection pan or pans (not shown) may be provided under brushes 12 to collect residue.

Further improvement in cleaning action may be achieved by providing liquid spray nozzles 20. Spray nozzles 20 may be positioned for wetting one or more of brush elements 12 or of selected portions of surface 6 with a cleaning liquid. The cleaning liquid may be water, solvent, a combination of the two, or other suitable liquid for removing foreign matter such as dried ink, lint, dust, clay, dirt and the like from surface 6. Spray nozzles 20 are preferably independently actuatable so as to wet the selected brushes 12 being moved to contact the selected portions of surface 6 to be cleaned, or to wet the selected surface portions themselves. In this way, the entire length of surface 6 parallel to axis 8 is not needlessly wetted and a web of the printing press is not needlessly saturated and/or unnecessary drying operations are not required. Respective valves 22, for example, may provide the independent actuation capability to spray nozzles 20. As with actuators 16, control of valves 22 may be integrated into, or share process logic with, a device for controlling ink fountains (not shown) of a printing press of which printing press cylinder 2 is a part.

Figure 3:
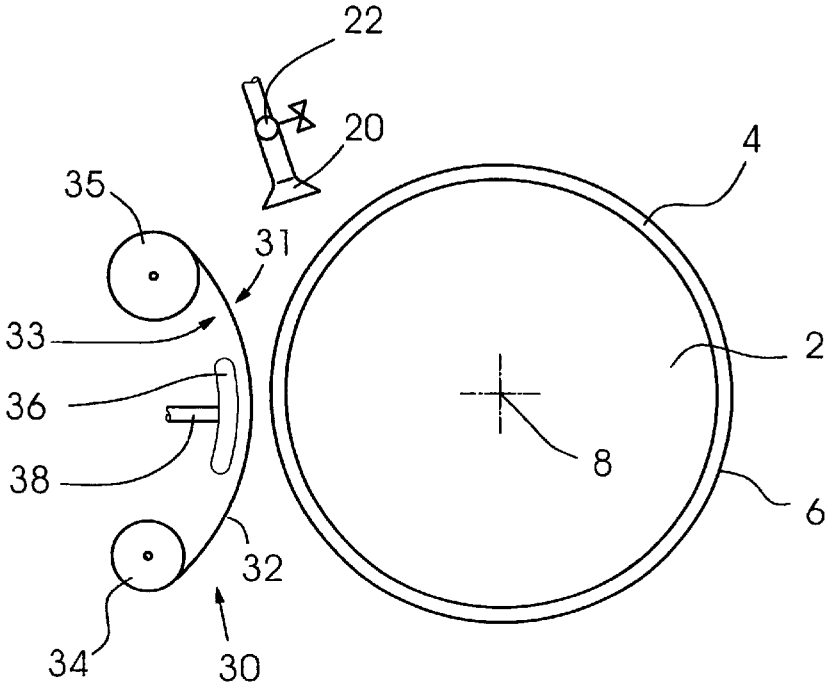
FIG. 3 shows a side schematic view of a printing press cylinder with a cleaning apparatus including a washer cloth and a plurality of adjacent air bladders.
Figure 4:
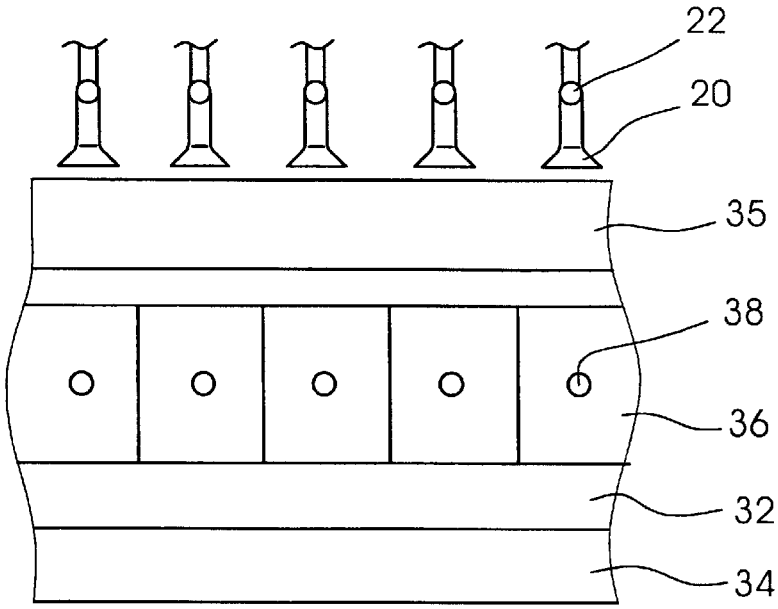
FIG. 4 shows a front schematic view of the cleaning apparatus shown in FIG. 3.

FIGS. 3–6 show a cleaning apparatus including a washer cloth. FIG. 3 shows a side schematic view of a printing press cylinder 2 with a cleaning apparatus 30 including a washer cloth 32 and a plurality of adjacent air bladders 36. As in FIG. 1, printing press cylinder 2 may be a blanket or a plate cylinder and includes overlay 4 mounted thereon. Overlay 4 is a blanket or a printing plate, corresponding to whether press cylinder is a blanket or a plate cylinder.

Air bladders 36 are each independently inflatable so as to move a corresponding section, or segment, of washer cloth 32 to contact one or more selected portions of surface 6 of overlay 4. With additional reference to FIG. 4, air bladders may be independently inflatable from air lines 38 by appropriate actuation of respective valves (not shown). By appropriately controlling the valves to inflate and/or deflate desired subsets of air bladders 36, selected sections of washer 32 may be moved to contact and clean the selected portions of surface 6. Control of the inflation valves may be integrated into, or share process logic with, a device for controlling ink fountains (not shown) of a printing press of which printing press cylinder 2 is a part. Washer cloth 32 may be deployed, or unrolled, from roll 34 so as to bring clean areas of the cloth into use, the used sections of washer cloth 32 being rolled onto roller 35.

As with the cleaning apparatus described with reference to FIG. 1, liquid spray nozzles 20 may be provided, the spray nozzles being independently actuatable so as to wet corresponding sections of washer cloth 32 being moved by to contact the selected portions of surface 6 to be cleaned, or to wet the selected portions of surface 6 themselves, with a cleaning liquid. In embodiments according to the present invention in which the wash cloth is to be wetted, spray nozzles 20 may be located to spray either cylinder side 31 or bladder side 33 of washer cloth 32. Control of valves 22 may be integrated into, or share process logic with, a device for controlling ink fountains (not shown) of a printing press of which printing press cylinder 2 is a part.

Figure 5:
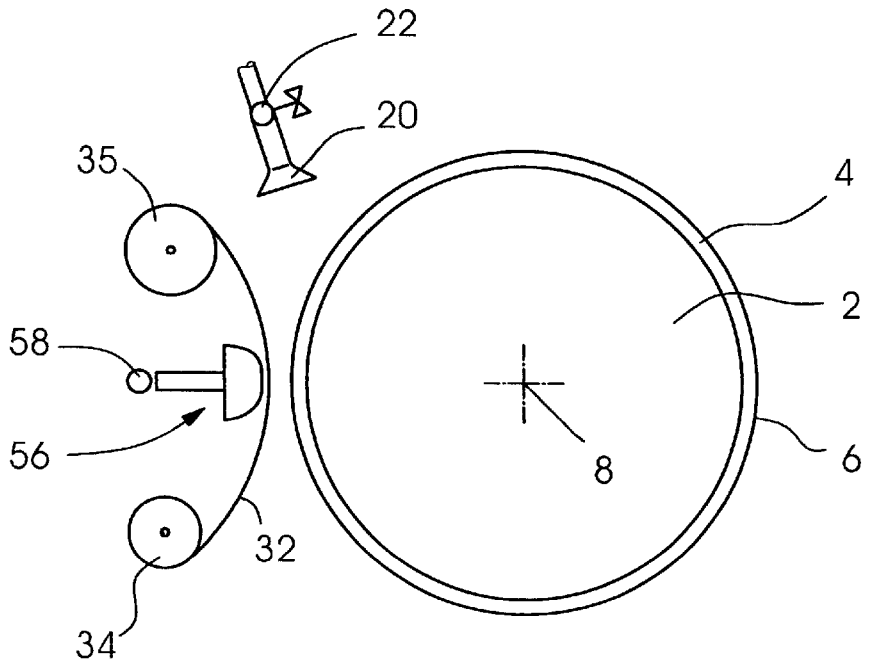
FIG. 5 shows a side schematic view of a printing press cylinder with a cleaning apparatus including a washer cloth and a plurality of adjacent pushing elements.
Figure 6:
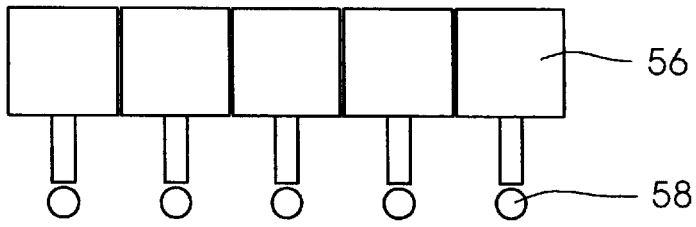
FIG. 6 shows a top schematic view of the pushing elements of the cleaning apparatus shown in FIG. 5.

FIG. 5 shows a side schematic view of a printing press cylinder 2 with a cleaning apparatus 50 including a washer cloth 32 and a plurality of adjacent pushing elements 56. FIG. 6 shows a top schematic view of pushing elements 56. As with FIGS. 1 and 3, printing press cylinder 2 may be a blanket or a plate cylinder and includes overlay 4 mounted thereon. Overlay 4 is a blanket or a printing plate, corresponding to whether press cylinder is a blanket or a plate cylinder.

Pushing elements 56 are each selectably and independently movable to contact a portion of surface 6 of overlay 4 under an action of actuator 58. Pushing elements 56 may be elastic curved elements or wheels, or other suitable devices for pushing corresponding sections of washer cloth 32 against surface 6 of press cylinder 2.

Actuators 58 may include any of pneumatic, hydraulic, lever, cam, electrical and magnetic devices suitable for selectively moving one or more of pushing elements 56 toward surface 6. The specific construction of such actuators would be known by those of skill in the art. Control of actuators 58 may be integrated into, or share process logic with, a device for controlling ink fountains (not shown) of a printing press of which printing press cylinder 2 is a part. In this way, control of actuators 58 may be effected according to the logic for controlling the ink fountains.

By appropriately controlling actuators 58 to move desired subsets of pushing elements 56 toward surface 6 of printing press cylinder 2, one or more selected portions of the surface may be cleaned by one or more corresponding sections of washer cloth 32 as cylinder 2 rotates about axis 8.

As in the embodiments described above, the cleaning apparatus having pushing elements 56 may include liquid spray nozzles 20.

In the preceding specification, the present invention has been described with reference to specific exemplary embodiments thereof. It will, however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. An apparatus for cleaning selected portions of a surface of a cylinder of a printing press, the apparatus comprising:

a plurality of brush elements disposed adjacent one another opposite the surface of the cylinder, the plurality of brush elements including a first brush element and a second brush element;

a device for selectively moving the first brush element to contact a first of the selected portions of the surface of the cylinder so as to clean the first selected portion and for selectively moving the second brush element to contact a second of the selected portions of the surface so as to clean the second selected portion; and a drive device for rotating the first brush element and for rotating the second brush element independently of the first brush element.

2. The apparatus as recited in claim 1 wherein the first brush element includes a brush wheel.

3. The apparatus as recited in claim 2 wherein the brush wheel has an axis and is rotated about the axis.

4. The apparatus as recited in claim 1 wherein the device for selectively moving the first and second brush elements includes at least one of a pneumatic, a hydraulic, a lever, a cam, an electrical and a magnetic actuator.

5. The apparatus as recited in claim 4 wherein the device for selectively moving the first and second brush elements includes at least two of the actuators.

6. The apparatus as recited in claim 1 wherein the cylinder is a blanket cylinder or a printing plate cylinder.

7. The apparatus as recited in claim 1 wherein the first and second brush elements have a gap between them, at least one of the first and second brush elements being movable along a part of the surface so as to improve the cleaning and/or to clean an area of the surface at the gap.

8. The apparatus as recited in claim 1 further comprising a spray device controllable to selectively deliver a cleaning liquid to at least one of the first or second of the plurality of brush elements or at least one of the first and second selected portions of the surface.

9. The apparatus as recited in claim 1 wherein the device for selectively moving the first and second brush elements includes a first actuator moving the first brush element radially with respect to the cylinder and a second actuator moving the second brush element radially with respect to the cylinder.

10. The apparatus as recited in claim 1 wherein the drive device includes a first driver rotating the first brush and a second driver rotating the second brush.

* * * * *